US007461527B2

(12) United States Patent
Yu

(10) Patent No.: US 7,461,527 B2
(45) **Date of Patent: *Dec. 9, 2008**

(54) STRAP LOCK WITH ANTI-REVERSE FUNCTION

(76) Inventor: Chun Te Yu, No. 253, Sec. 3, Yanhai Rd., Fusing Township, Changhua County 506 (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/812,047

(22) Filed: Jun. 14, 2007

(65) Prior Publication Data

US 2008/0028805 A1 Feb. 7, 2008

Related U.S. Application Data

(63) Continuation-in-part of application No. 10/998,647, filed on Nov. 30, 2004, and a continuation-in-part of application No. 10/792,875, filed on Mar. 5, 2004.

(51) Int. Cl.
*E05B 73/00* (2006.01)
*E05B 65/52* (2006.01)

(52) U.S. Cl. ..... 70/18; 70/58; 70/69; 70/284; 70/285

(58) Field of Classification Search ..... 70/18, 70/58, 21, 69, 284, 285, DIG. 63, DIG. 71; 24/166, 167, 171, 195, 196, 265 BC
See application file for complete search history.

(56) References Cited

U.S. PATENT DOCUMENTS 4,662,040 A * 5/1987 Terrell et al. ..... 24/625
4,685,315 A * 8/1987 Comolli ..... 70/68
4,912,950 A 4/1990 Crowle
5,123,153 A 6/1992 Krauss
5,309,610 A 5/1994 le Gal et al.
5,417,455 A 5/1995 Drinane et al.
5,729,877 A 3/1998 Kong et al.
6,016,675 A 1/2000 Te et al.
6,189,348 B1 * 2/2001 Huang ..... 70/18
6,647,750 B2 * 11/2003 Kaneko et al. ..... 70/58
6,871,517 B2 * 3/2005 Bonelli et al. ..... 70/58
6,883,354 B1 * 4/2005 Yu ..... 70/18
6,912,879 B1 * 7/2005 Yu ..... 70/58
7,032,415 B2 4/2006 Young
7,104,095 B1 * 9/2006 Lin ..... 70/58
7,360,283 B2 * 4/2008 Yu ..... 24/171
2004/0112098 A1 * 6/2004 Bonelli et al. ..... 70/58

(Continued)

*Primary Examiner*—Lloyd A Gall
(74) *Attorney, Agent, or Firm*—Birch, Stewart, Kolasch & Birch, LLP

(57) ABSTRACT

A strap lock includes a first snapping member, a second snapping member, a strap, a stop member and a locking mechanism. The second snapping member is detachably secured to the first snapping member. The strap is connected with both the first and the second snapping members to define a loop of a size for enclosing a luggage. The strap includes a movable section capable of being pulled out away from the second snapping member so as to reduce the loop size. The stop member is disposed on the first snapping member for preventing the movable section of the strap from moving backward to the second snapping member. The locking mechanism is mounted on the first snapping member. The locking mechanism is in a locking state when the second snapping member is not allowed to depart from the first snapping member, and in an unlocking state when the second snapping member is allowed to depart from the first snapping member.

11 Claims, 8 Drawing Sheets

U.S. PATENT DOCUMENTS

2005/0055810 A1* 3/2005 Loughlin et al. ..... 24/615
2006/0207301 A1* 9/2006 Yu ..... 70/58
2006/0207302 A1* 9/2006 Yu ..... 70/58
2006/0272368 A1* 12/2006 Yu ..... 70/58
2007/0084256 A1* 4/2007 Wu ..... 70/58
2007/0175247 A1* 8/2007 Yu ..... 70/58
2007/0266746 A1* 11/2007 Yu ..... 70/69
2008/0016921 A1* 1/2008 Yu ..... 70/18
2008/0041126 A1* 2/2008 Yu ..... 70/58

* cited by examiner

STRAP LOCK WITH ANTI-REVERSE FUNCTION

CROSS REFERENCE TO RELATED APPLICATION

This is a continuation-in-part application of application Ser. No. 10/792,875, filed on 5 Mar. 2004, and also a continuation-in-part application of application Ser. No. 10/998,647, filed on 30 Nov. 2004.

BACKGROUND OF INVENTION

1. Field of Invention

This invention relates to a strap lock, and more particularly to the dual-locking buckle having an anti-reverse function.

2. Related Prior Art

A conventional strap lock in accordance with a prior art shown in FIGS. 7 and 8 comprises a strap 5, a first snapping member 41, a second snapping member 40 detachably secured on the first snapping member 41. The second snapping member 40 has a first end defining a first passage 401 and a second passage 402 spaced from the first passage 401 and a second end detachably buckled into one end of the first snapping member 41. The strap 5 connects the first snapping member 41 and the second snapping member 40 to enclose a luggage 60. The strap 5 includes a fixed section 50, a movable section 51 and a driven section 52. The fixed section 50 is non-adjustably secured on the other end of the first snapping member 41. The movable section 51 is fed into the first passage 401 and the second passage 402 to loop around a first crossbar 403 of the second snapping member 40, and then rest between a second crossbar 404 and the driven section 52 which extends from the movable portion 51 but not pass around the first crossbar 403.

In operation, after the luggage 60 is enclosed by the strap 5 and the second snapping member 40 is buckled into the first snapping member 41 as shown in FIG. 7, the movable section 51 of the strap 5 is pulled outward in the direction of arrow A to tighten up the strap 5 so that the luggage 60 is tightly bound and locked by the strap lock to prevent the luggage 60 from being opened. However, referring to FIG. 8, when the first snapping member 41 is driven to move or pivot outward relative to the luggage 60 until the movable section 51 of the strap 5 is parallel with the driven section 52 as depicted, the movable section 51 is released from the second snapping member 40 and is moved backward as indicated by the arrows "B". In this manner, the strap 5 can be loosed from the luggage 60 easily, so the strap lock is useless no matter it is locked by a locking mechanism or not.

U.S. Pat. No. 4,662,040 discloses a "strap buckle" having male and female components which are connected to respective opposite ends of a strap. The female component has a rear wall formed with a longitudinal extension. The male component includes bars for being looped by an end of the strap. When the two components are operatively connected, the rear wall extension passes over the bars in close relationship and thereby serves to hold the looped strap portion in the clamped disposition relative to the bars. In particular, two overlying parts of the strap are closely confined between the fixed bar and a bottom of the rear wall extension such that it is at least difficult to move them to a position where the clamping effect of the connection is significantly reduced. Thus the strap buckle has advantage of preventing or minimizing slippage of the adjustable end portion of the strap even under the most severe conditions of use. However, the strap buckle disclosed above is no more than a "buckle" applicable for buoyancy jackets and vests as required to be carried on boats. There is no locking mechanism in the strap buckle for further security.

SUMMARY OF INVENTION

The present invention is to mitigate and/or obviate the disadvantage of the conventional strap lock.

The primary objective of the present invention is to provide a strap lock having an anti-reverse function.

In accordance with the present invention, there is provided a strap lock, comprising a first snapping member, a second snapping member, a strap, a stop member and a locking mechanism.

The second snapping member is detachably secured to the first snapping member. The strap is connected with the first and the second snapping members so as to define a loop of a size for enclosing a luggage. The strap has a movable section capable of being pulled out away from the second snapping member so as to reduce the loop size. The stop member is disposed on the first snapping member for preventing the movable section of the strap from moving backward to the second snapping member. The locking mechanism disposed on the first snapping member. The locking mechanism is in a locking state when the second snapping member is locked in the first snapping member, and in an unlocking state when the second snapping member is allowed to depart from the first snapping member.

It is in this manner that the strap lock with the stop member providing the anti-reverse function can be extremely simple modified and inexpensively produced.

Further benefits and advantages of the present invention will become clear as the description proceeds.

BRIEF DESCRIPTION OF DRAWINGS

The invention will now be elucidated with reference to the following description and accompanying drawings where.

DETAILED DESCRIPTION OF PREFERRED EMBODIMENT

Figure 1:
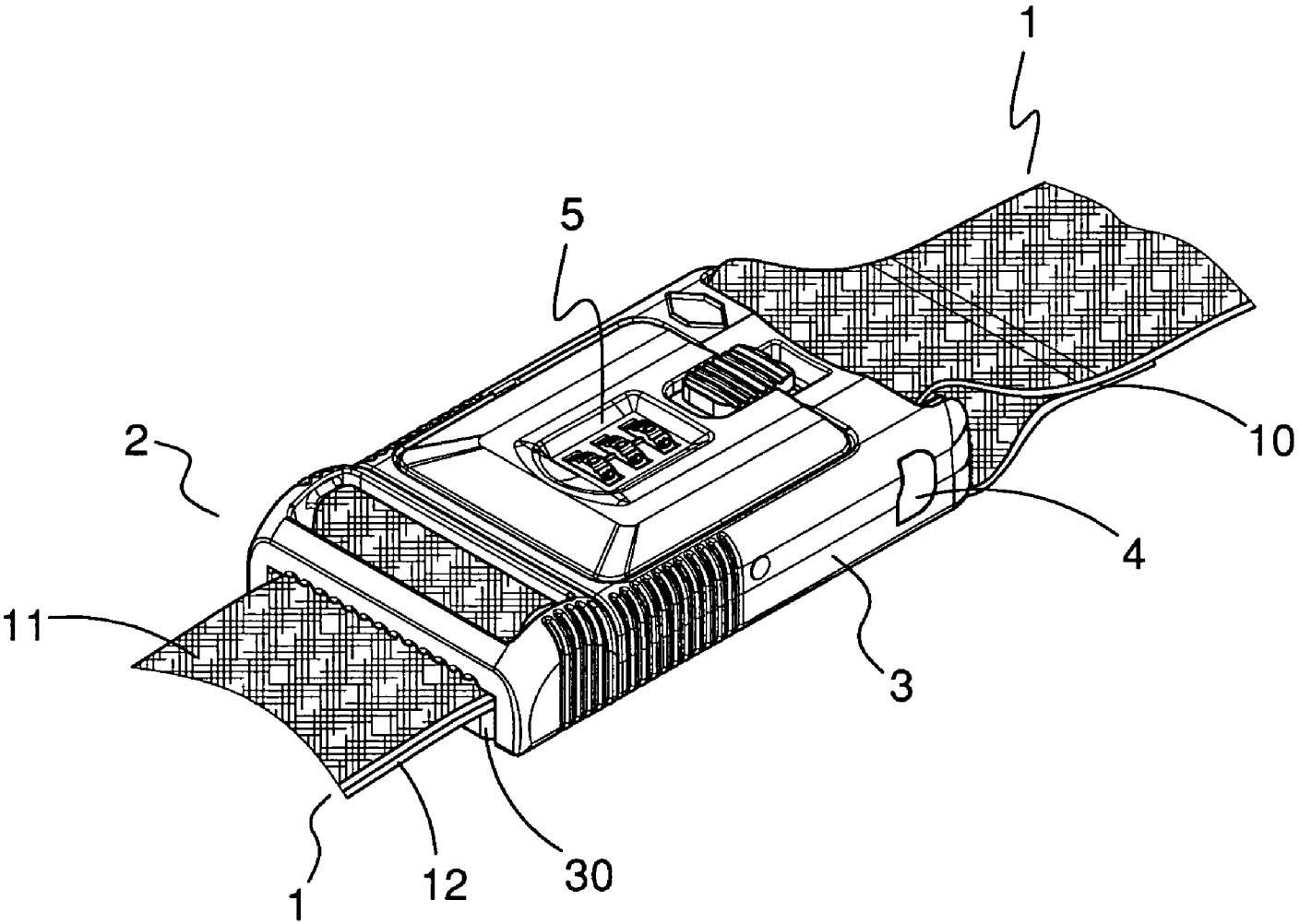
FIG. 1 is a perspective view of a strap lock according to the preferred embodiment of the present invention.

With reference to FIGS. 1 to 6, a strap lock in accordance with the preferred embodiment of the present invention comprises a first snapping member 3, a second snapping member 2, a strap 1, a stop member 30 and a locking mechanism including a key-operated locking unit 4 and a combination locking unit 5.

Figure 2:
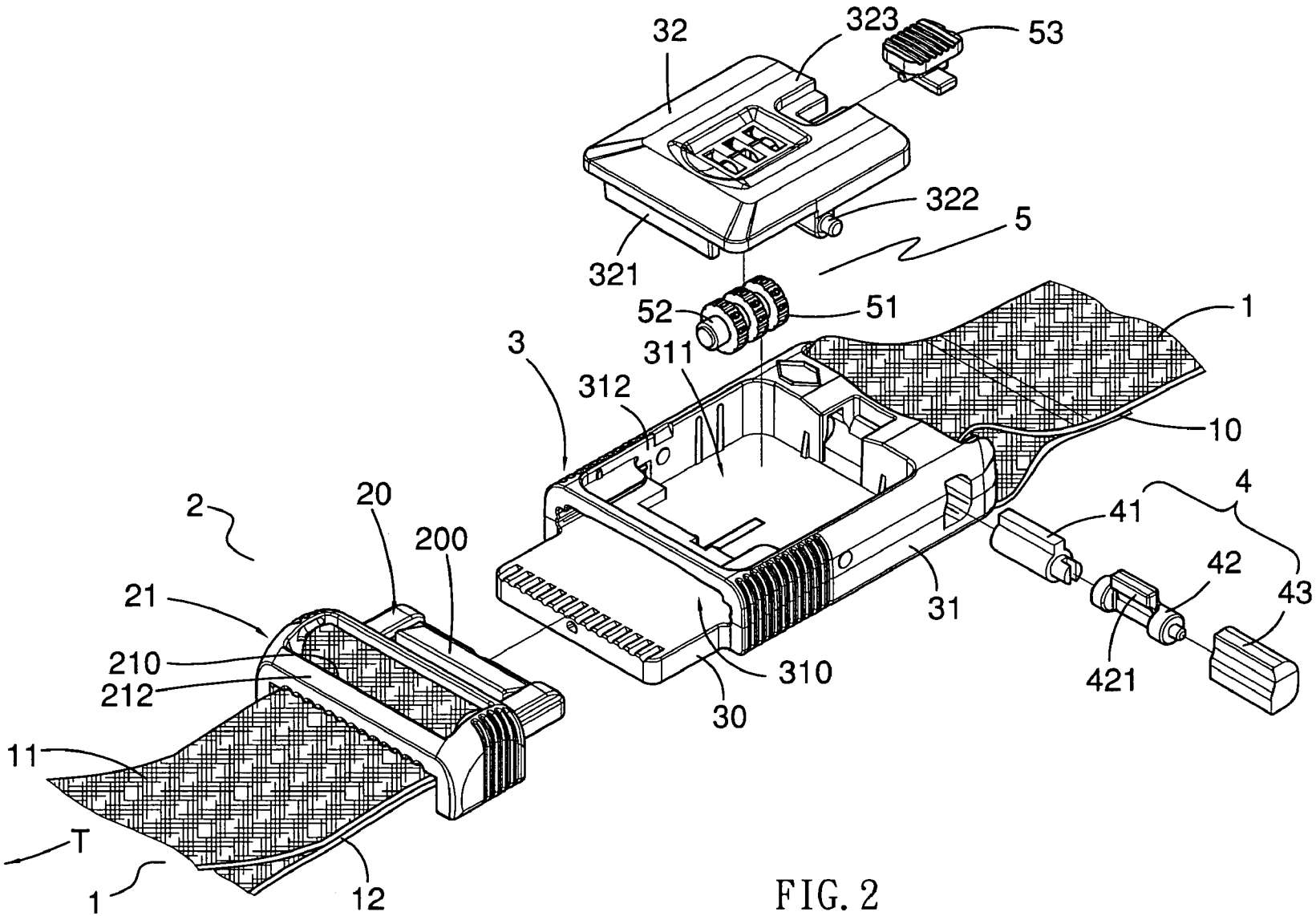
FIG. 2 is an exploded view of the strap lock shown in FIG. 1.

As best seen in FIG. 2, the first snapping member 3 includes a first body 31 and a second body 32. The first body 31 defines an opening 310 in a front edge thereof and is recessed to form an operation room 311 in communication with the opening 310. The second body 32 has two sides formed with two projecting pivots 322 near a middle section thereof for pivotally connecting with two sides 312 of the operating room 311 of the first body 31. Thus, the second body 32 is swingable about the pivots 322 and can be teetered back and forth within the operation room 311 of the first body 31. One end of the second body 32 is formed with an engaging portion 321 corresponding to a hook 200 of a fastening portion 20 of the second snapping member 2. The key-operated locking unit 4 and the combination locking unit 5 are disposed on the first body 31 and the second body 32 respectively and will be set forth later.

Figure 3:
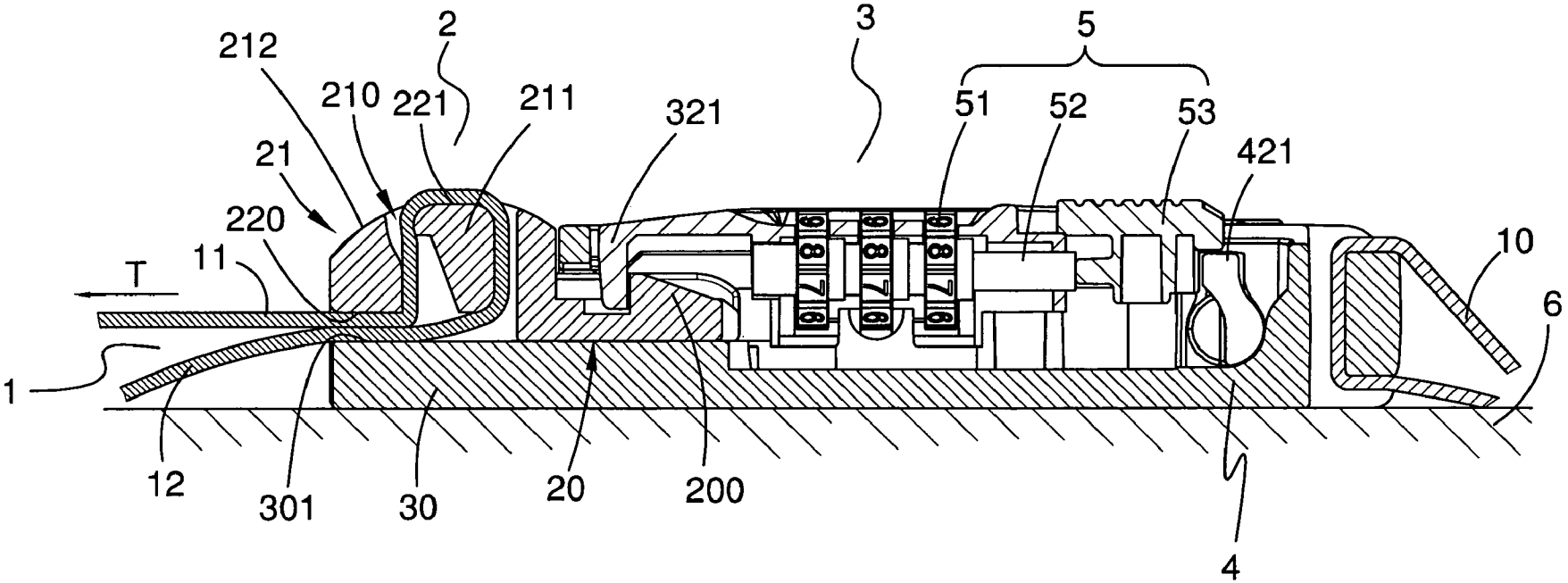
FIG. 3 is a cross sectional view of the strap lock, showing two snapping members of the strap lock are in cooperative engagement.
Figure 4:
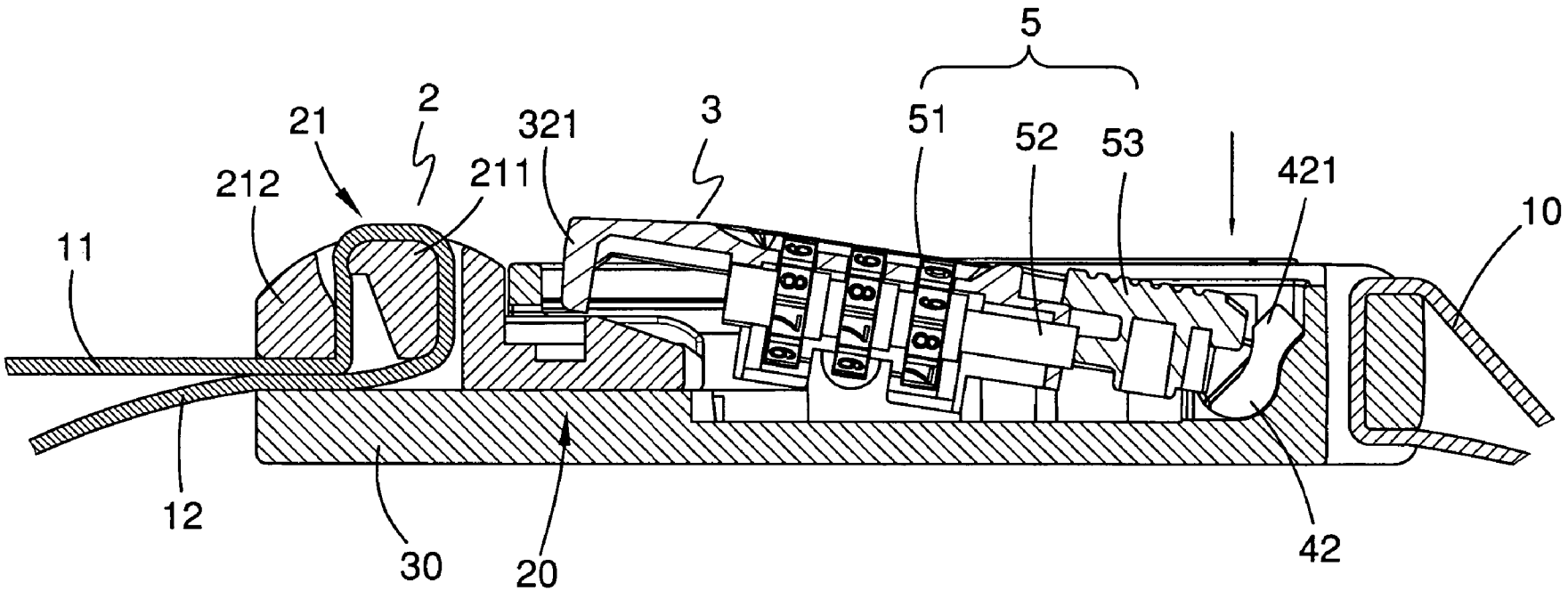
FIG. 4 is a cross sectional view of the strap lock, showing the strap lock is unlocked by a key-operated locking unit.

The second snapping member 2 can be inserted into the opening 310 and detachably buckled into the first snapping member 3. As depicted in FIGS. 2 and 3, the second snapping member 2 includes the fastening portion 20, a holding portion 21 defining a room 210 therein, a first crossbar 211 placed in the middle of the room 210, and a second crossbar 212 parallel with the first crossbar 211 and connected with a rear of the holding portion 21. The first crossbar 211 has a top 221 higher than a bottom 220 of the second crossbar The fastening portion 20 is connected with a front of the holding portion 21 and is formed with the hook 200. When the fastening portion 20 of the second snapping member 2 is inserted into the opening 310 of the first body 31 of the first snapping member 3, the hook 200 of the fastening portion 20 is engaged with the engaging portion 321 of the second body 32 of the first snapping member 3. The other end of the second body 32 is a press end 323 which can be pressed to lift the end with the engaging portion 321 so that the engaging portion 321 can be released from the hook 200 of the fastening portion 20 as illustrated in FIG. 4.

Referring now to FIG. 3, the strap 1 connects the first snapping member 3 and the second snapping member 2 so as to define a loop of a size (not shown) for enclosing a luggage 6. The strap 1 includes a fixed section 10, a movable section 11 and a driven section 12 moved with the movable section 11. The movable section 11 passes around the first crossbar 211 and is fed between the first and the second crossbars 211, 212 and can be pulled out away from the second snapping member 2 as indicated by arrow T so as to reduce the loop size for tightening up. The fixed section 10 is non-adjustably secured on the first snapping member 3 in this embodiment. However, it is not necessary for the fixed section 10 to be fixedly secured on the first snapping member 3 but detachably connected. The driven section 12 extends from one end of the movable section 11 but not being fed into the room 210 of the holding portion 21.

The stop member 30 extends out the opening 310 from a side of the first snapping member 3 and underlies the second snapping member 2 so as to prevent the movable section 11 of the strap 1 from moving backward to the second snapping member 2 when the strap lock is locked.

Figure 6:
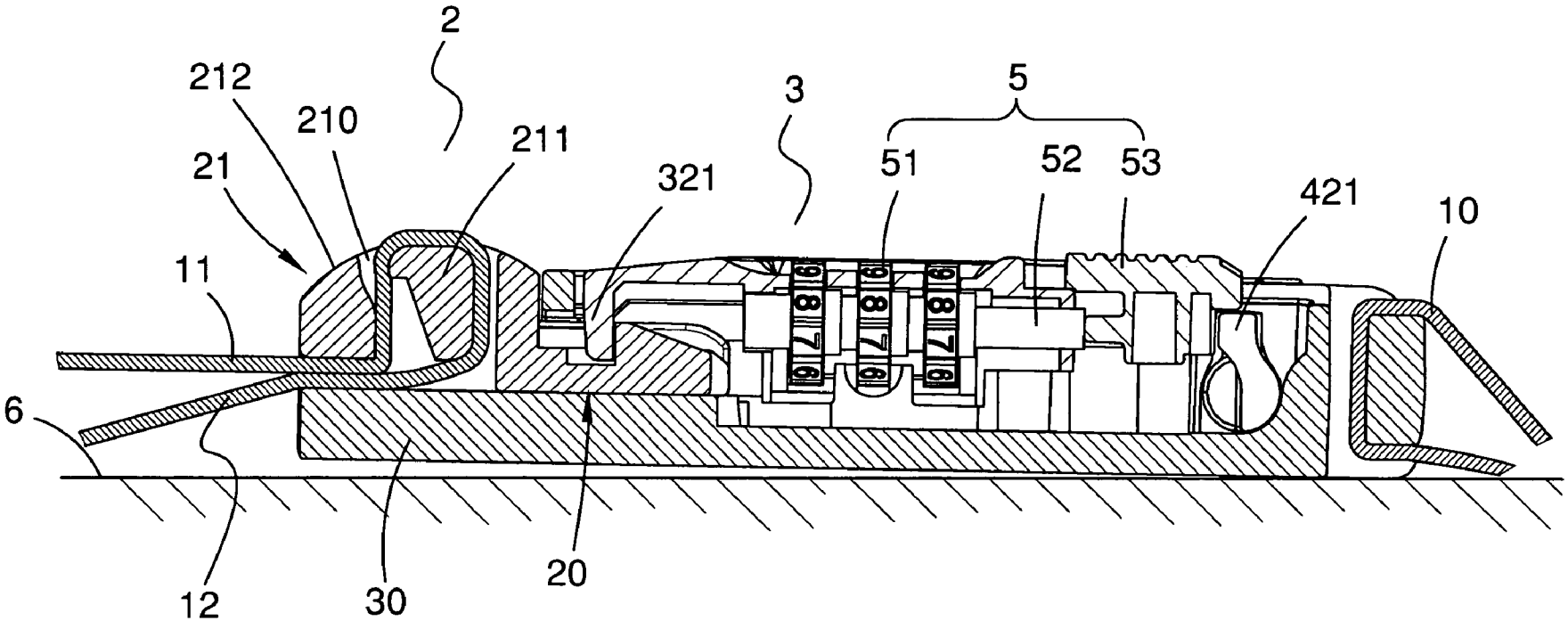
FIG. 6 is a cross sectional view of the strap lock, showing the strap lock producing an anti-reverse action.
Figure 7:
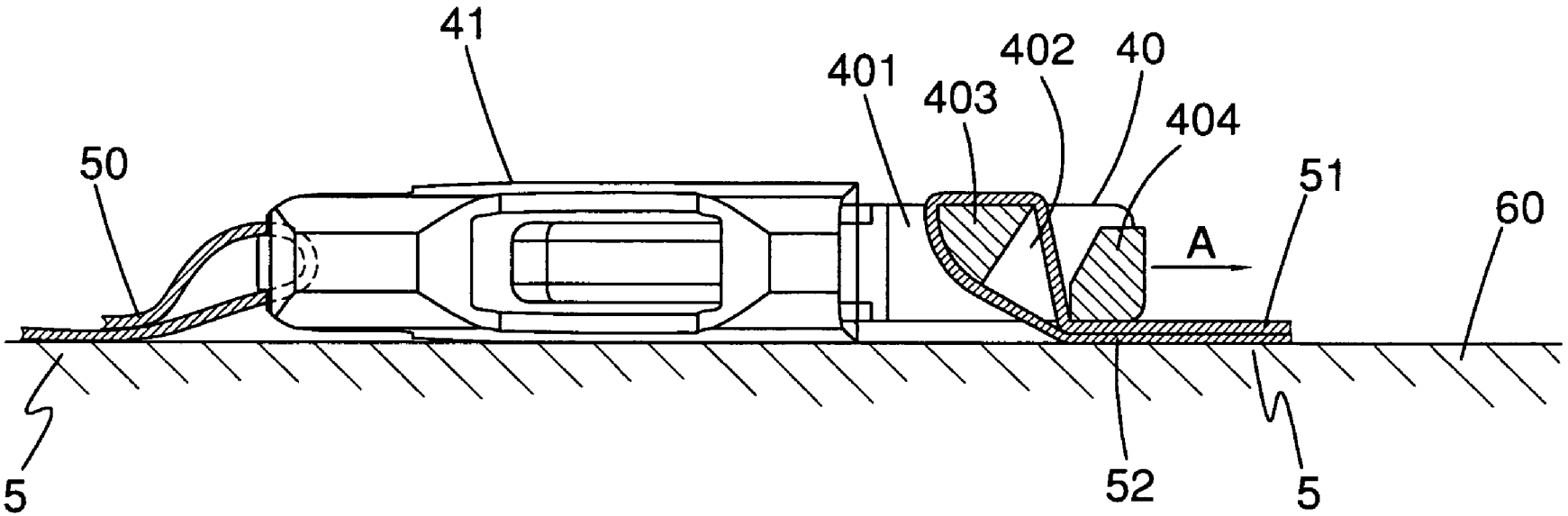
FIG. 7 PRIOR ART
FIGS. 7 and 8 show a prior art.
Figure 8:
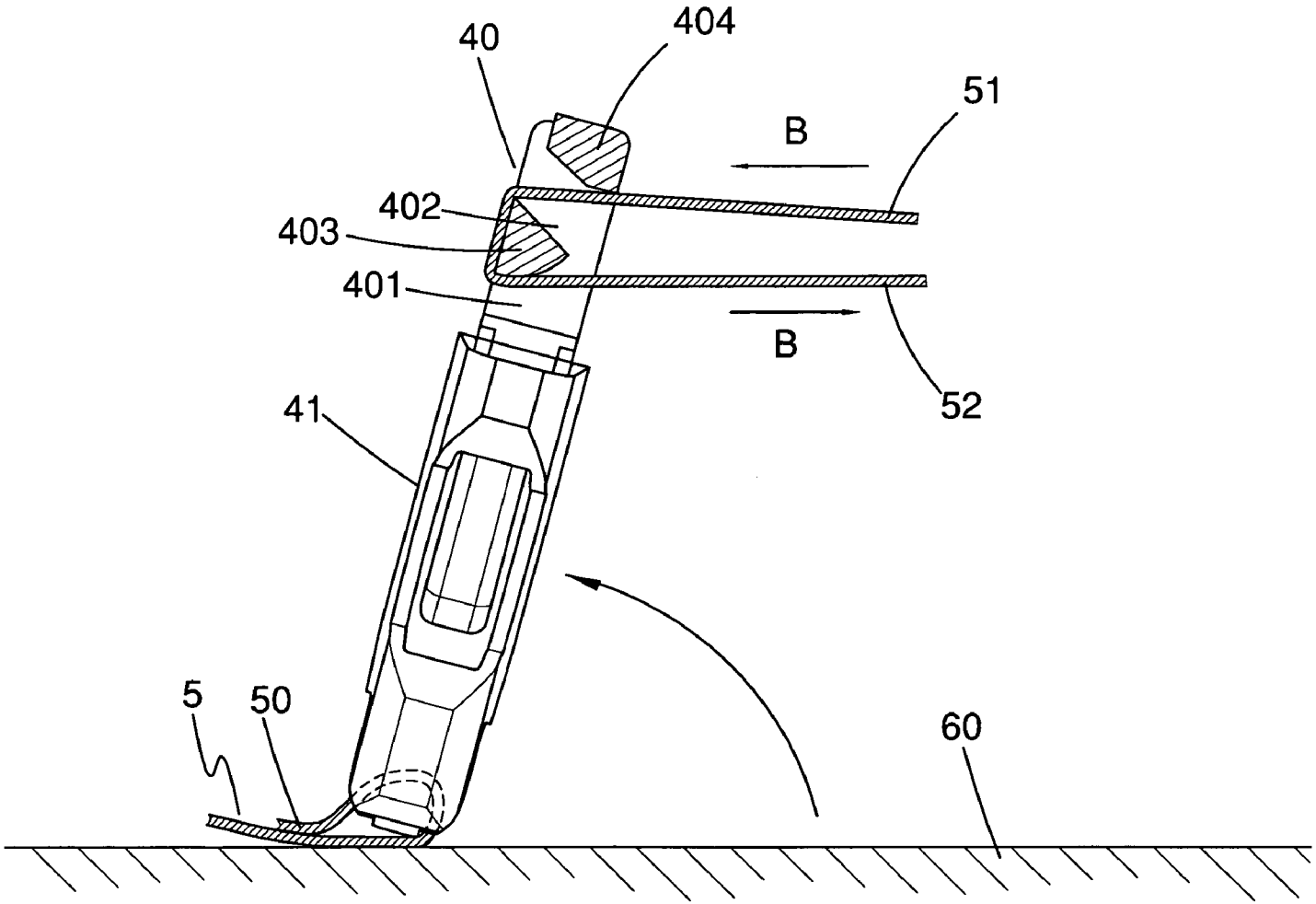
FIG. 8 PRIOR ART

In operation, when the fastening portion 20 of the second snapping member 2 is inserted into the opening 310 of the first snapping member 3 and the driven section 12 is overlapped with the other end of the movable section 11 between the bottom 220 of the second crossbar and a top 301 of the stop member, the movable section 11 of the strap 1 can then be pulled outward in the direction indicated by the arrow "T" and is retained by the second crossbar 212 of the second snapping member 2 and the top 301 of the stop member 30 so as to tighten the strap 1, thereby binding the strap lock on the luggage 6. In such a manner, when the strap lock is driven to move or pivot outward relative to the luggage 6 as shown in FIG. 6, movement of the strap 1 is further restricted by a sharp corner of the stop member 30, so that the movable section 11 of the strap 1 cannot be released from the second snapping member 2 and cannot be moved backward by pulling the driven section 12, thereby preventing the strap 1 from being loosened from the luggage 6 so as to provide an anti-reverse effect.

The key-operated locking unit 4, fitted in the first body 31, comprises a locating member 43 and a lock core comprising a lock core body 41 and a block 42. The lock core body 41 is coupled with one end of the block 42 and can be inserted by a key (not shown) to rotate so as to drive the block 42 to rotate simultaneously. A support section 421 projects from the block 42, whereby by operating the key to rotate the lock core body 41, the support section 421 of the block 42 can be shifted between a locking position where the support section 421 stops a lower side of a controlling member 53 of the combination locking unit 5, as illustrated in FIG. 3, and an unlocking position where the support section 421 releases the controlling member 53, as illustrated in FIG. 4. Next, once the controlling member 53 is released from the block 42, the press end 323 of the second body 32 can then be pressed to lift the engaging portion 321 so as to release the hook 200 of the second snapping member 2 from the opening 310 of the first snapping member 3.

Figure 5:
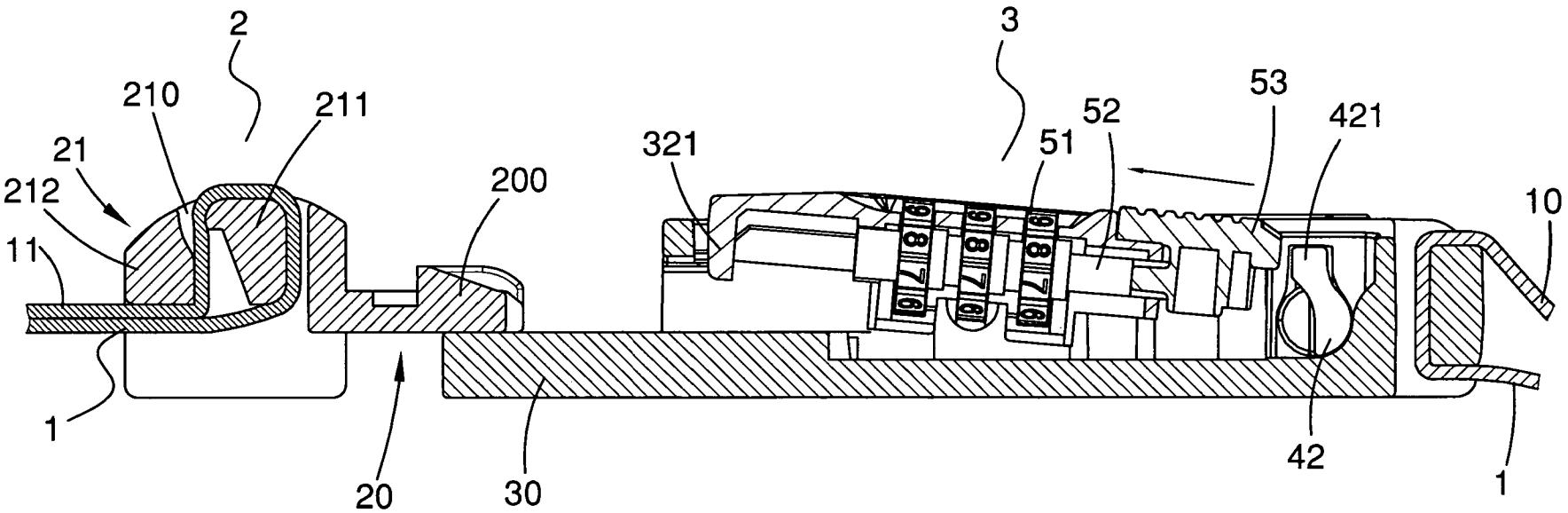
FIG. 5 is a cross sectional view of the strap lock, showing the strap lock is unlocked by a combination locking unit.

Referring to FIGS. 3 and 5, the combination locking unit 5 includes a number wheel assembly 51, a movable member 52 and the controlling member 53 such as a push button. The number wheel assembly 51 is served to control movement of the movable portion 52 by entering a code. The controlling member 53 abuts against an end of the movable member 52. When the number wheel assembly 51 is entered the code to allow the movable member 52 to move, the controlling member 53 can be manipulated between a locking position, as shown in FIG. 3, and an unlocking position where the controlling member 53 departs from the support section 421 of the block 42, as shown in FIG. 5. When the controlling member 53 departs from the block 42 to the unlocking position, the press end 323 of the second body 32 can then be pressed to lift the engaging portion 321 so as to release the hook 200 of the second snapping member 2 from the opening 310 of the first snapping member 3.

Accordingly, when either the support section 421 of the block 42 is in the unlocking position or the controlling member 53 is in the unlocking position, the second body 32 is allowed to move to release the second snapping member 2 from the first snapping member 3, and whereby the strap is unlocked. That is, the locking mechanism is in an unlocking state when the second snapping member 2 is allowed to depart from the first snapping member 3 by either the key-operated locking unit 4 or the combination locking unit 5. On the contrary, only when the support section 421 of the block 42 is in the locking position and the controlling member 53 is in the locking position, as depicted in FIG. 3, the second body 32 is confined and immovable. That is, the locking mechanism is in a locking state, when the second snapping member 2 is locked in the first snapping member 3 by both the key operated locking unit 4 and the combination locking unit 5.

As noted above, the lock core of the key-operated locking unit 4 cooperates with the movable member 52 of the combination locking unit 5 to control movement of the second body 32 so as to lock or unlock the strap lock. The stop member 30 provides further restriction for an anti-reverse function. It is in this manner that the dual-locking strap lock with the stop member providing the anti-reverse function can be extremely simple modified and inexpensively produced.

Numerous characteristics and advantages of the invention have been set forth in the foregoing description. The disclosure, however, is illustrative only, and changes may be made in detail within the principle of the invention, to the full extent indicated by the broad general meaning of the terms in which the appended claims are expressed.

The invention claimed is:

1. A strap lock comprising:

a first snapping member;

a second snapping member detachably secured to the first snapping member;

a strap connected with the first and the second snapping members to define a loop of a size for enclosing a luggage; the strap having a movable section capable of being pulled out away from the second snapping member so as to reduce the loop size;

a stop member configured to prevent the movable section of the strap from moving backward to the second snapping member; and a locking mechanism disposed on the first snapping member and including a key-operated locking unit and a combination locking unit wherein the locking mechanism is in a locking state when the second snapping member is locked in the first snapping member by both the key-operated locking unit and the combination locking unit, and in an unlocking state when the second snapping member is allowed to depart from the first snapping member by either one of the key-operated locking unit and the combination locking unit.

2. The strap lock of claim 1 wherein:

the first snapping member includes an opening;

the second snapping member includes a holding portion, a fastening portion, a first crossbar and a second crossbar; the holding portion defines a room; the fastening portion is connected with a front of the holding portion and is capable of being inserted into the opening of the first snapping member; the first crossbar is positioned in the room; the second crossbar parallel with the first crossbar is connected with a rear of the holding portion; the first crossbar has a top higher than a bottom of the second crossbar; and the strap includes a fixed section connected with the first snapping member; the movable section of the strap passes around the first crossbar and is fed between the first and the second crossbars.

3. The strap lock of claim 2 wherein the stop member extends out the opening from a side of the first snapping member; the strap includes a driven section extending from one end of the movable section; and when the fastening portion of the second snapping member is inserted into the opening of the first snapping member, the driven section is overlapped with the other end of the movable section between a bottom of the second crossbar and a top of the stop member.

4. The strap lock of claim 2 wherein the first snapping member includes a first body and a second body; the second body is movably mounted on the first body; the key-operated locking unit is disposed in the first body; the combination locking unit is disposed in the second body; when the locking mechanism is in the locking state, the second body is immovable and thereby the fastening portion is lodged in the opening; and when the locking mechanism is in the unlocking state, the second body is allowed to move to a position where the fastening portion can be released from the opening.

5. The strap lock of claim 4 wherein the key-operated locking unit includes a lock core, and the lock core can be inserted by a key to rotate; the combination locking unit includes a number wheel assembly and a movable member; the number wheel assembly is served to control movement of the movable member by entering a code; and the lock core cooperates with the movable member to control movement of the second body.

6. The strap lock of claim 5 wherein the key-operated locking unit further includes a block connected with the lock core; the block can be driven by the lock core to be shifted between a first locking position and a first unlocking position; the combination locking unit further includes a controlling member connected with the movable member; when the number wheel assembly allows the movable member to move, the controlling member can be shifted between a second locking position and a second unlocking position; wherein when the block is in the first locking position and the controlling member is in the second locking position, the second body is immovable; and when the block is moved to the first unlocking position or the controlling member is moved to the second unlocking position, the second body is allowed to move.

7. The strap lock of claim 4 wherein the fastening portion has a hook; the second body has at least one pivot and an engaging portion; and the second body is swingable about the pivot on the first body so that the engaging portion of the second body can be engaged with or released from the hook of the fastening portion.

8. A strap lock comprising:

a first snapping member;

a second snapping member detachably secured to the first snapping member;

a strap connected with the first and the second snapping members to define a loop of a size for enclosing a luggage; the strap having a movable section capable of being pulled out away from the second snapping member so as to reduce the loop size;

a stop member configured to prevent the movable section of the strap from moving backward to the second snapping member; and a locking mechanism disposed on the first snapping member;

wherein the locking mechanism includes a first locking unit and a second locking unit; the first snapping member includes a first body and a second body; the second body is movably mounted on the first body; the first locking unit is disposed in the first body; the second locking unit is disposed in the second body; when the locking mechanism is in the locked state, the second body is immovable and thereby the second snapping member is lodged in the first snapping member; and when the locking mechanism is in the unlocked state, the second body is allowed to move to a position where the second snapping member can be released from the first snapping member.

9. The strap lock of claim 8 wherein the first locking unit is a key-operated locking unit; the second locking unit is a combination locking unit; the key-operated locking unit includes a lock core, the lock core can be inserted by a key to rotate; the combination locking unit includes a number wheel assembly and a movable member; the number wheel assembly is served to control movement of the movable member by entering a code; and the lock core cooperates with the movable member to control movement of the second body.

10. The strap lock of claim 9 wherein the key-operated locking unit further includes a block connected with the lock core; the block can be driven by the lock core to be shifted between a first locking position and a first unlocking position; the combination locking unit further includes a controlling member connected with the movable member; when the number wheel assembly allows the movable member to move, the controlling member can be shifted between a second locking position and a second unlocking position; wherein when the block is in the first locking position and the controlling member is in the second locking position, the second body is immovable; and when the block is moved to the first unlocking position or the controlling member is moved to the second unlocking position, the second body is allowed to move.

11. The strap lock of claim 8 wherein the second snapping member has a hook; the second body has at least one pivot and an engaging portion; and the second body is swingable about the pivot on the first body so that the engaging portion of the second body can be engaged with or released from the hook of the second snapping member.

* * * * *